US011160424B2

(12) United States Patent
Song

(10) Patent No.: US 11,160,424 B2
(45) Date of Patent: Nov. 2, 2021

(54) APPARATUS FOR LIFTING MOVABLE BASE OF TOILET

(71) Applicant: Soon Young Song, Anyang-si (KR)

(72) Inventor: Soon Young Song, Anyang-si (KR)

( * ) Notice: Subject to any disclaimer, the term of this patent is extended or adjusted under 35 U.S.C. 154(b) by 0 days.

(21) Appl. No.: 17/033,972

(22) Filed: Sep. 28, 2020

(65) Prior Publication Data

US 2021/0100411 A1 Apr. 8, 2021

(30) Foreign Application Priority Data

Oct. 4, 2019 (KR) ..... 10-2019-0122826

(51) Int. Cl.
*A47K 13/10* (2006.01)
*A47K 17/02* (2006.01)

(52) U.S. Cl.
CPC ..... *A47K 13/10* (2013.01); *A47K 17/026* (2013.01)

(58) Field of Classification Search
CPC ..... A47K 13/10
USPC ..... 4/667
See application file for complete search history.

(56) References Cited

U.S. PATENT DOCUMENTS 10,219,659 B1 * 3/2019 Armstrong ..... A47K 11/06
2005/0083207 A1 * 4/2005 Smith ..... A61F 5/3776 340/668
2007/0056084 A1 * 3/2007 Watt ..... A47K 13/10 4/246.1
2017/0258652 A1 * 9/2017 Latham ..... A47K 11/04
2020/0393442 A1 * 12/2020 Hall ..... G01N 33/493
2021/0212527 A1 * 7/2021 Choi ..... A61G 5/14

FOREIGN PATENT DOCUMENTS

KR 20-0232669 Y1 10/2001

* cited by examiner

*Primary Examiner* — Christine J Skubinna
(74) *Attorney, Agent, or Firm* — Revolution IP, PLLC

(57) ABSTRACT

The disclosure relates to an apparatus for lifting a movable base of a toilet, and more particularly to an apparatus for lifting a movable base of a toilet, which can simplify a structure and assist a toilet user in safely standing up by making the movable base where the toilet user sits be automatically movable with a simple structure, be driven to have lifting movement and pivoting movement, and be structured to minutely generate the pivoting movement, and which can quickly deal with emergency situations of a user by making an alarm go off in the emergency situations and transmitting information about the emergency situations to at least one previously set terminal.

2 Claims, 6 Drawing Sheets

[FIG.1]
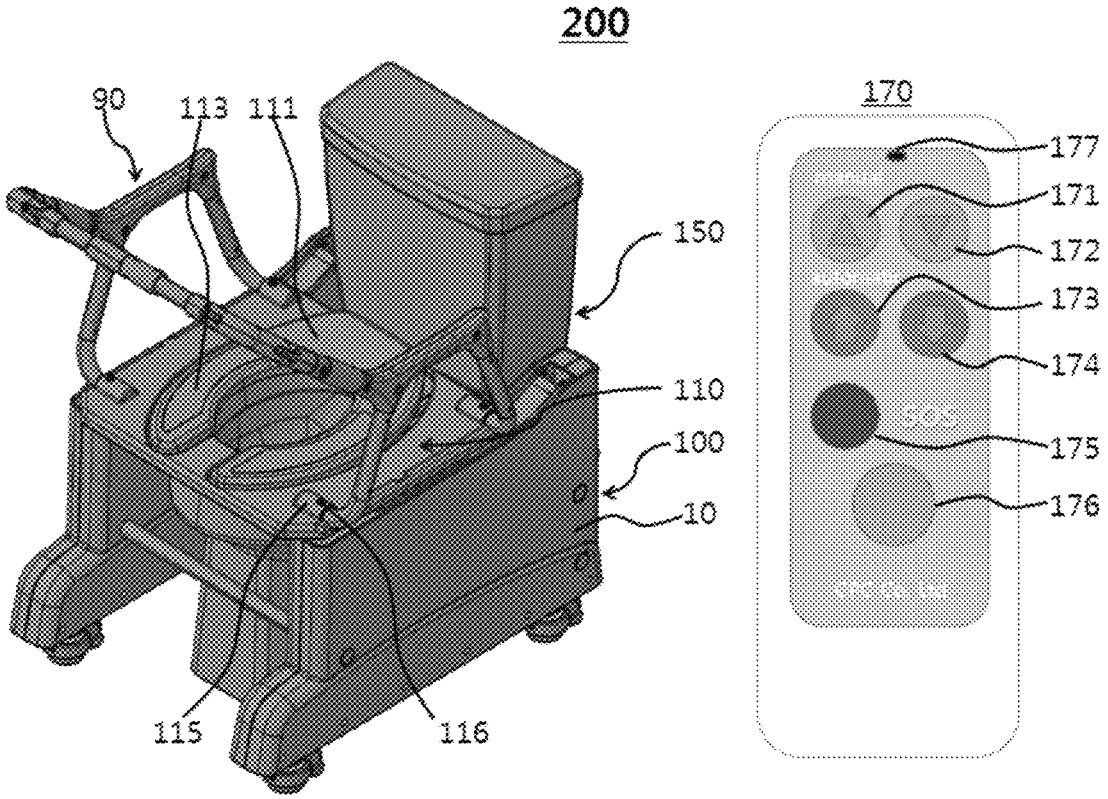

[FIG.2]
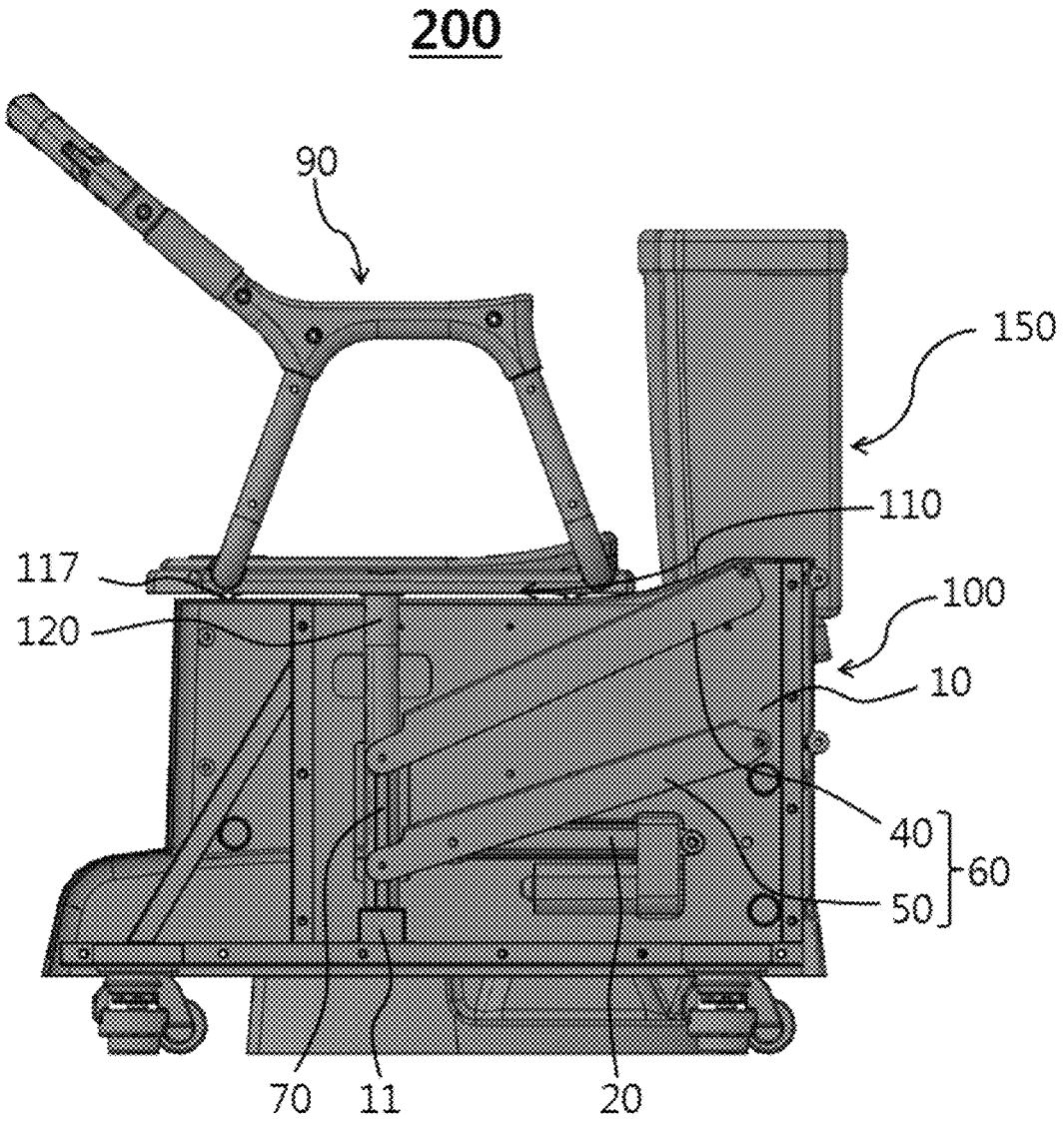

[FIG.3]
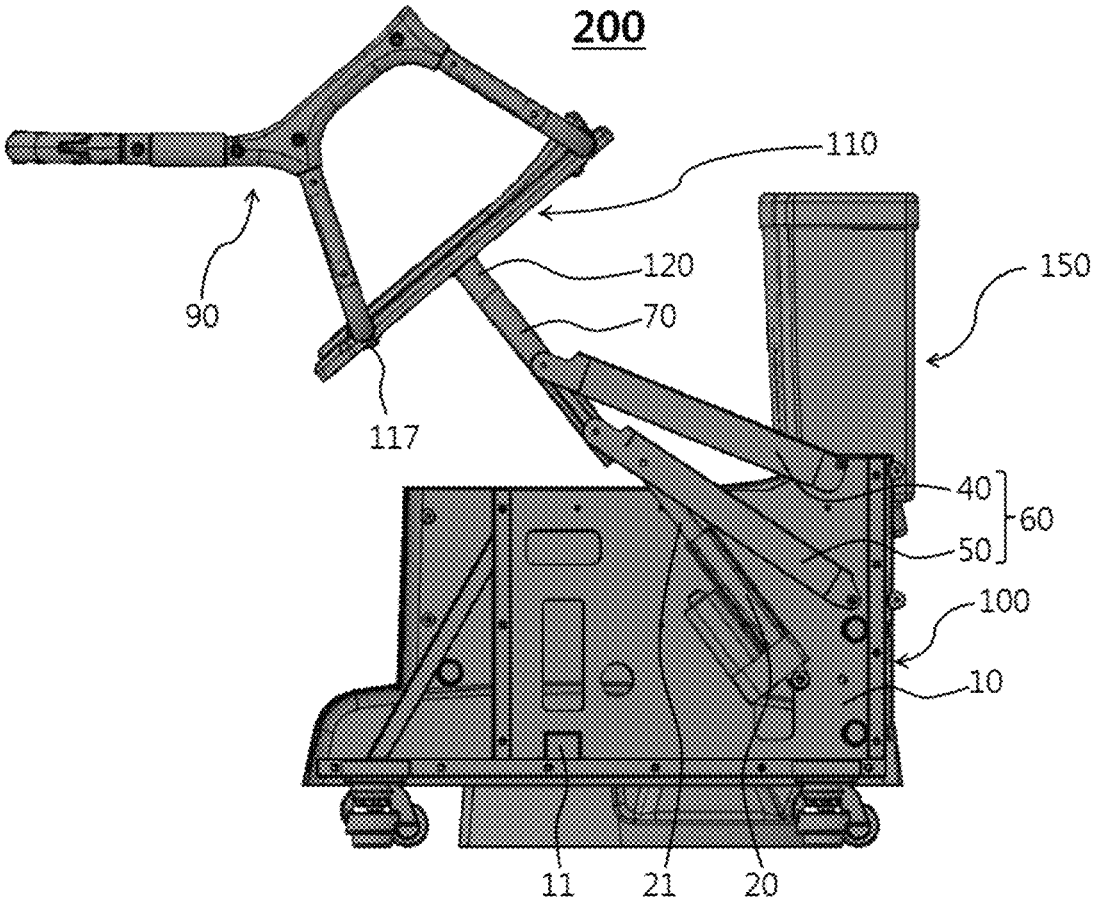

[FIG.4]
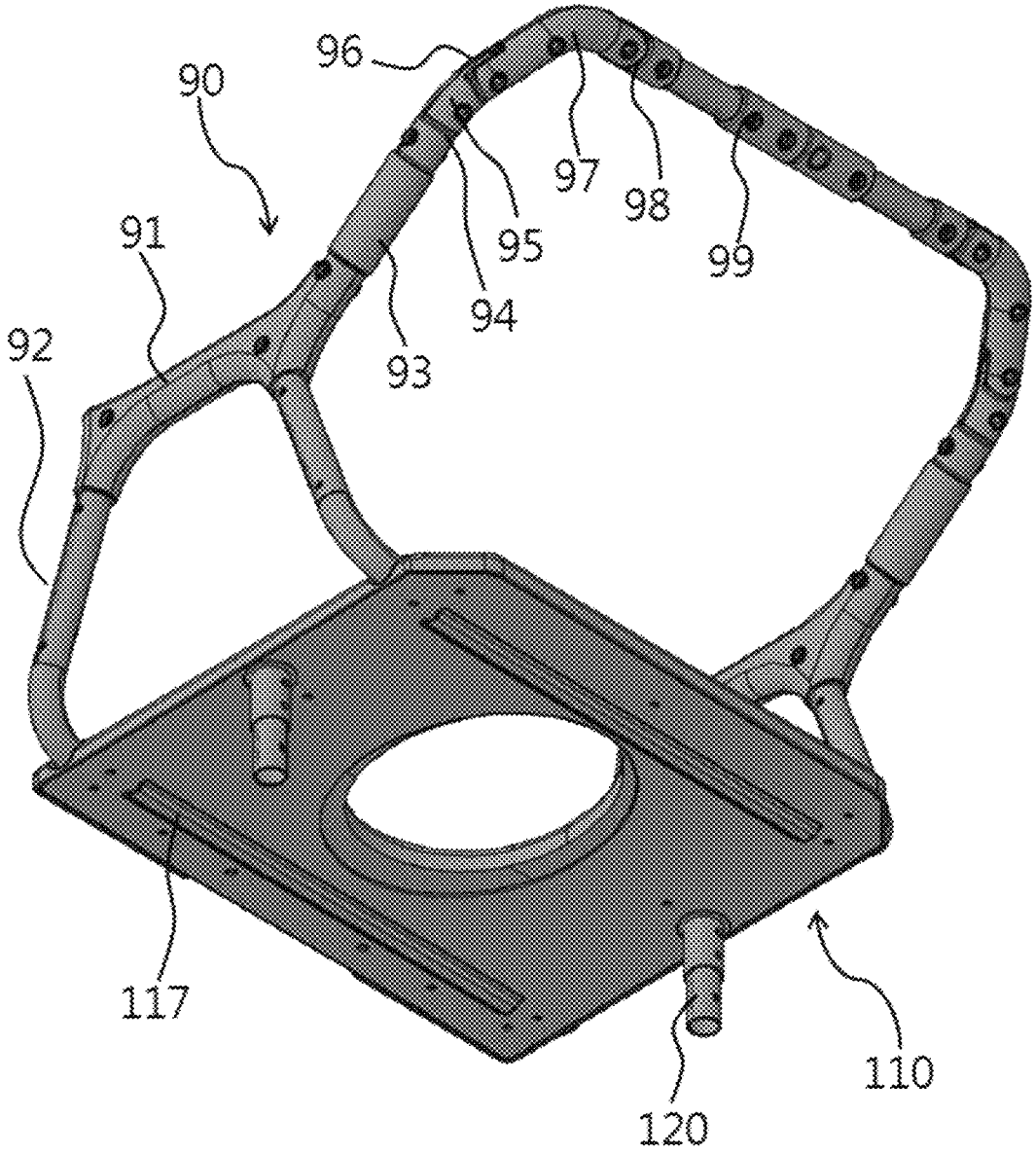

[FIG.5]
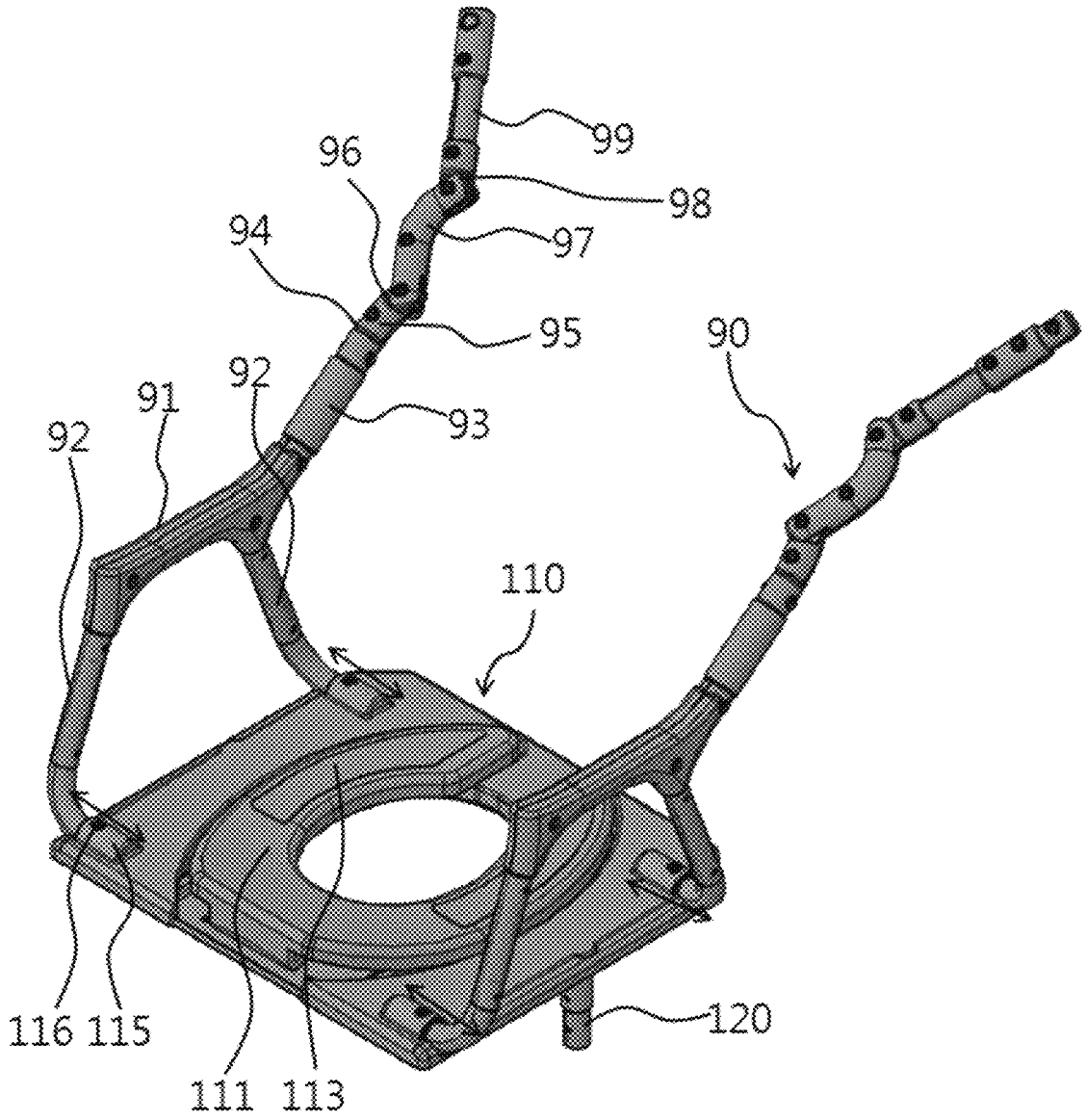

[FIG.6]
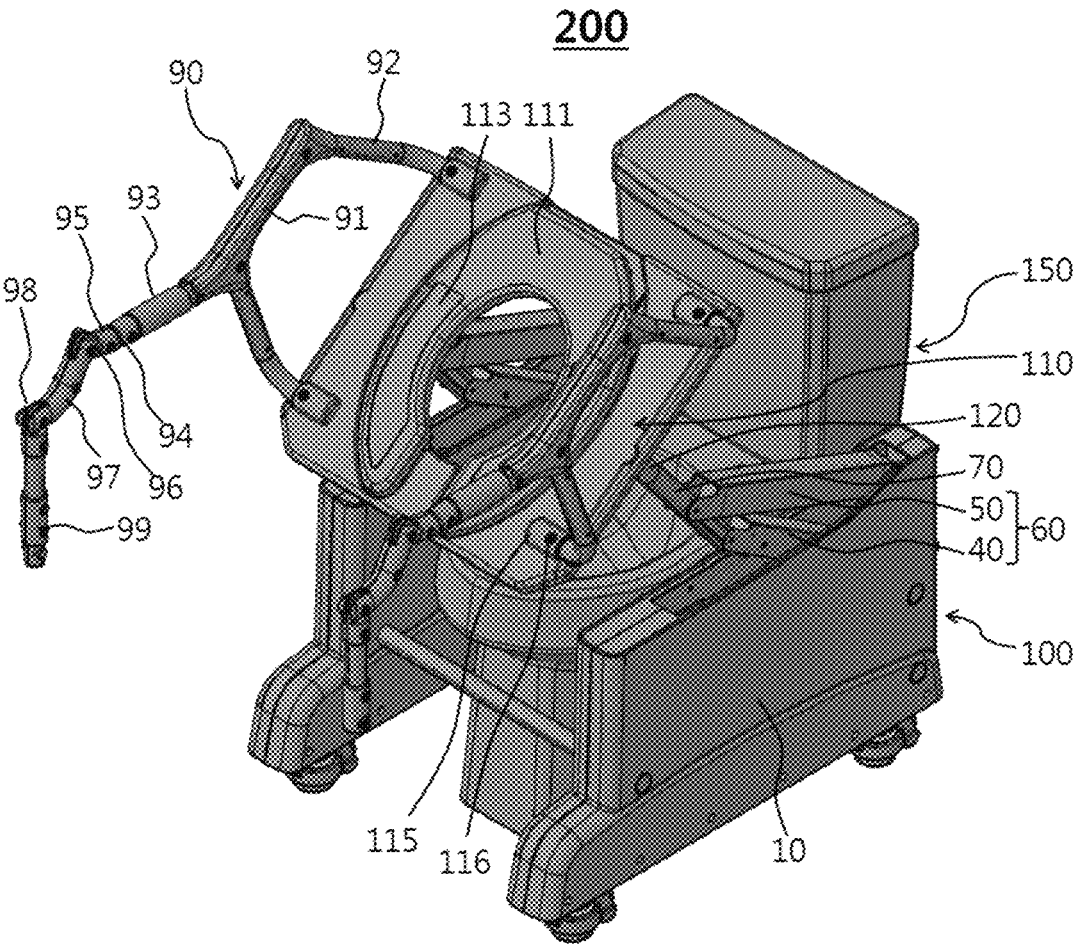

APPARATUS FOR LIFTING MOVABLE BASE OF TOILET

CROSS-REFERENCE TO RELATED APPLICATION

This application claims priority from Korean Patent Application No. 10-2019-0122826 filed on Oct. 4, 2019 in the Korean Intellectual Property Office, the disclosure of which is incorporated herein by reference.

BACKGROUND OF THE INVENTION

(a) Field of the Invention

The disclosure relates to an apparatus for lifting a movable base of a toilet, and more particularly to an apparatus for lifting a movable base of a toilet, which can simplify a structure and assist a toilet user in safely standing up by making the movable base where the toilet user sits be automatically movable with a simple structure, be driven to have lifting movement and pivoting movement, and be structured to minutely generate the pivoting movement, and which can quickly deal with emergency situations of a user by making an alarm go off in the emergency situations and transmitting information about the emergency situations to at least one previously set terminal.

(b) Description of the Related Art

In general, a toilet includes a main body installed on a floor and having a moderate height so that a user can sit to relieve himself/herself, and a seat provided on the top of the main body and hinged at the back to be lifted up as necessary.

Such a toilet is comfortable to sit down and relieve nature, but makes various sick people, elderly or weak people, and disabled people, whose legs are weak, feel much difficulty in standing up from a seating position after easing nature.

To make up for such shortcomings, an sub sidebar has been conventionally installed around a toilet so that the sick people, elderly or weak people, and disabled people can sit down or stand up grabbing the side bar. However, most of them whose legs are weak are also weak in arms and therefore have a problem of difficulty in leaning on the side bar.

To solve this problem, Korean Utility Model No. 20-0232669 (hereinafter, referred to as the "related art") has proposed a toilet seat for the elderly, the weak and the lower-body disabled so that the disabled, the elderly, the weak and the like lower-body handicapped people can easily stand up from a sitting position without effort after relieving nature.

The toilet seat of the related art has an advantage of assisting the elderly, the weak and the like people in standing up easily, but is useless for the elderly, the weak and the disabled who cannot operate it with their own strength because the toilet seat employs a structure of being operated by the strength of the elderly, the weak and the like people. Besides, the toilet seat of the related art has a disadvantage of resulting in considerably high possibility of unexpected severe accidents while the elderly, the weak and the disabled operate it with their own strength.

Further, to assist the elderly, the weak and the like people in easily and safely standing up, not only lifting movement for vertically moving the seat up and down but also pivoting movement to be used in combination with the lifting movement is required. However, such combination of the lifting movement and the pivoting movement makes a structure complicated and big. Accordingly, there is a need of a standing aid having a simple and small structure.

Further, too much pivoting movement of the seat may cause the elderly, the weak and the like people to fall forward, and in this case, there is considerably high possibility that the elderly, the weak and the like people may have irreversible severer accidents.

In addition, conventionally, a user cannot let someone know emergency situations even when the user is in the emergency situations, and therefore it is impossible to actively deal with safety accidents that the user has.

SUMMARY OF THE INVENTION

Accordingly, the disclosure is conceived to solve the foregoing problems, and an aspect of the disclosure is to provide an apparatus for lifting a movable base of a toilet, which can simplify a structure and assist a toilet user in safely standing up by making the movable base where the toilet user sits be automatically movable with a simple structure, be driven to have lifting movement and pivoting movement, and be structured to minutely generate the pivoting movement, and which can quickly deal with emergency situations of a user by making an alarm go off in the emergency situations and transmitting information about the emergency situations to at least one previously set terminal.

In accordance with an embodiment of the present disclosure, there is provided an apparatus for lifting a movable base of a toilet, including: a movable base structured to allow a user of a toilet to sit thereon, and movably mounted to the toilet; a base actuator disposed adjacent to the toilet and actuating the movable base to operate having at least one of lifting movement and pivoting movement, and a control device controlling operations of the base actuator, wherein the control device includes an SOS button, a speaker making an alarm go off, and a controller controlling the alarm to go off through the speaker when the SOS button is pressed and controlling information about emergency situations to be transmitted to at least one previously set terminal, wherein the base actuator includes: a casing adjacent to and stationarily mounted to the toilet; a driver mounted to an inside of the casing; and a link assembly connected to an actuation bar detachably coupled to a coupling bar formed in a bottom of the movable base, and operating the actuation bar to produce lifting movement and pivoting movement of the movable base as driven by the driver.

The link assembly may include a first pivoting link having a first end pivotally connected to the casing and a second end pivotally connected to the actuation bar, and a second pivoting link placed above the first pivoting link and including a first end pivotally connected to the casing and a second end pivotally connected to the actuation bar, and the driver may be pivotally connected to the casing, and a driving shaft of the driver may be driven to move forward and backward by the driver as pivotally connected to the first pivoting link or the second pivoting link.

The first pivoting link and the second pivoting link may be disposed in parallel with each other, and the second pivoting link may be longer than the first pivoting link.

BRIEF DESCRIPTION OF THE DRAWINGS

The above and/or other aspects of the disclosure will become apparent and more readily appreciated from the following description of the exemplary embodiments, taken in conjunction with the accompanying drawings, in which:

FIG. 1 is a perspective view of an apparatus for lifting a movable base of a toilet according to an embodiment of the disclosure;

FIG. 2 is a lateral view of an apparatus for lifting a movable base of a toilet according to an embodiment of the disclosure before operation (in a movable-base down state);

FIG. 3 is a lateral view of an apparatus for lifting a movable base of a toilet according to an embodiment of the disclosure after operation (in a movable-base up state);

FIG. 4 is a perspective view of a movable base and a closed safety bar in an apparatus for lifting the movable base of a toilet according to an embodiment of the disclosure;

FIG. 5 is a perspective view of a movable base and an opened safety bar in an apparatus for lifting the movable base of a toilet according to an embodiment of the disclosure; and FIG. 6 is a perspective view of an opened safety bar in an apparatus for lifting a movable base of a toilet according to an embodiment of the disclosure after operation (in a movable-base up state).

DETAILED DESCRIPTION

Below, embodiments of an apparatus for lifting a movable base of a toilet according to the disclosure with the foregoing objects, solutions, and effects will be described in detail with reference to the accompanying drawings.

As shown in FIGS. 1 to 6, an apparatus 200 for lifting a movable base of a toilet according to an embodiment of the disclosure includes a movable base 110 having a structure allowing a user of a toilet 150 to sit thereon, a base actuator 100 adjacent to the toilet 150 and actuating movement of the movable seat 110, and a control device 170 controlling operations of the base actuator 100.

The movable seat 110 is movably mounted to the toilet 150. In other words, the movable seat 110 has a structure on which a user of the toilet 150 sits, and is movably mounted to the toilet 150. The movable seat 110 may be a general seat bundled with the toilet 150, or a special seat provided separately from the general seat bundled with the toilet 150.

The movable seat 110 has a structure that a user of the toilet 150 can sit on. Further, the movable seat 110 may be configured for direct contact with hips of a toilet user, or may be configured to indirectly contact and support the hips of the user with an additional medium (or a separate seat, etc.) interposed between the movable seat 110 and the hips.

The movable base 110 may include a seat 111 corresponding to a portion with which a toilet user's buttocks are in contact. Meanwhile, when the movable base 110 moves up and leans forward by operations of the base actuator 100, a user who sits on the seat 111 may fall forward. To prevent this, a nonslip pad 113 may be attached to the seat 111. The nonslip pad 113 may be made of a neoprene material.

The movable seat 110 is not immovably but movably mounted to the toilet 150, and therefore fastened to the seat actuator 100 as put on the rim of the toilet 150. In other words, the movable seat 110 is mounted onto the rim of the toilet 150 as fastened to the seat actuator 100, and thus kept movable corresponding to operations of the seat actuator 100.

The movement of the movable seat 110 is driven by the seat actuator 100. That is, the movable seat 110 has lifting movement and/or pivoting movement according to the operations of the seat actuator 100 so that a user of the toilet 150 can stand up, i.e. rise from the movable seat 110. The seat actuator 100 operates to make the movable seat 110 have either the lifting movement or the pivoting movement or have both the lifting movement and the pivoting movement.

Thus, the seat actuator 100 according to the disclosure is adjacent to the toilet 150 and controls the movement of the movable seat 110 so that the movable seat 110 can have at least one of the lifting movement and the pivoting movement.

The seat actuator 100 needs to have a structure to be conveniently and easily installed without spoiling an outer appearance since it is provided adjacent to the toilet 150 and makes the movable seat 110 move, i.e. have at least one movement between the lifting movement corresponding to vertical reciprocation and the pivoting movement corresponding to rotation.

The operations of the base actuator 100 are controlled by the control device 170. In other words, the control device 170 controls operations of a driver for the base actuator 100, so that the base actuator 100 can actuate the movement of the movable base 110.

The control device 170 may be provided as a control panel embedded in the base actuator 100 while exposing only various operation control buttons to the outside, or a remote controller as shown in FIG. 1. In the latter case, the base actuator 100 includes a control receiving module (not shown) that receives an operation control signal from the control device 170 provided in the form of the remote controller and controls the operations of the driver for the base actuator 100.

The control device 170 may include various operation control buttons as shown in FIG. 1. In other words, the control device 170 includes up-buttons 171 and 173 and down-buttons 172 and 174 for operating the base actuator 100 to actuate the movable base 110 to move up or down, and further includes an SOS button 175, a speaker 176 that makes an alarm go off, and a controller (not shown) that controls the alarm to go off through the speaker 176 when the SOS button 175 is pressed and controls information about emergency situations to be sent to at least one previously set terminal.

The up-button is provided as divided into a manual up-button 171 and an automatic up-button 173, and the down-button is provided as divided into a manual down-button 172 and the automatic down-button 174.

The automatic up-button 173 generates a control signal for making the base actuator 100 actuate the movable base 110 to move up to the topmost position at a time, and transmits the control signal to the control receiving module (not shown). Then, the control receiving module (not shown) controls the driver to drive the movable base 110 to move up to the topmost position at a time. Therefore, a user only needs to press the automatic up-button 173 once without continuously pressing the automatic up-button 173 to thereby make the base actuator 100 actuate the movable base 110 to move up to the topmost position.

On the other hand, the automatic down-button 174 generates a control signal for making the base actuator 100 actuate the movable base 110 to move from a moved-up state up to the bottommost position at a time, and transmits the control signal to the control receiving module (not shown). Then, the control receiving module (not shown) controls the driver to drive the movable base 110 to move down up to the bottommost position at a time. Therefore, a user only needs to press the automatic down-button 173 once without continuously pressing the automatic down-button 174 to thereby make the base actuator 100 actuate the movable base 110 to move down up to the bottommost position.

Meanwhile, unlike the automatic up-button 173, the manual up-button 171 does not make the movable base 110 move up to the topmost position when pressed once, but makes the base actuator 100 actuate the movable base 110 to move up to the topmost position only when pressed continuously. Therefore, the manual up-button 171 is kept pressed by a user until the movable base 110 moves up to a position desired by him/her.

On the other hand, unlike the automatic down-button 174, the manual down-button 172 does not make the movable base 110 move down up to the bottommost position when pressed once, but makes the base actuator 100 actuate the movable base 110 to move down up to the bottommost position only when pressed continuously. Therefore, the manual down-button 172 is kept pressed by a user until the movable base 110 moves down up to a position desired by him/her.

The control device 170 includes the SOS button 175, the speaker 176 and the controller (not shown) to quickly deal with emergency situations. The SOS button 175 refers to a button to be pressed when a user is in the emergency situations. When the SOS button 175 is pressed to input an emergency signal to the controller (not shown), the controller (not shown) controls the speaker 176 to operate so that a siren or the like alarm can go off.

Meanwhile, when the SOS button 175 is pressed to input the emergency signal to the controller (not shown), the controller (not shown) controls information about the emergency situations to be transmitted to at least one previously set terminal independently from controlling the speaker 176 to trip the alarm. The at least one previously set terminal may include mobile phones of a member of family, a person concerned in a local government, a person concerned in the police, etc. Therefore, the controller may previously set and register a phone number of at least one terminal.

When the SOS button 175 is pressed, the controller transmits information about the emergency situations to at least one terminal having the previously set and registered phone number. The information about the emergency situations may include a short message service (SMS) message. For example, the controller controls "Emergency situations," "SOS", or the like SMS message as the information about the emergency situations to be sent to at least one preset terminal. To this end, the control device 170 may further include a text sending module (not shown).

Further, the information about the emergency situations may include location information. Here, the location information may include address information or global positioning system (GPS) information about a location where the apparatus for lifting the movable base of the toilet according to the disclosure is installed. The global positioning system (GPS) information may be previously set and registered without preparing a separate GPS module. When the SOS button 175 is pressed, the controller controls the previously set and registered location information to be transmitted to at least one terminal having the previously set and registered phone number.

Further, the information about the emergency situations may include recording information. To this end, the control device 170 may further include a microphone 177. When the SOS button 175 is pressed, the controller controls a recording operation to be performed for a preset period of time from a point in time when the emergency signal is input (for example, for 10 seconds or 1 minute from the point in time when the emergency signal is input), and controls the recording information to be transmitted to at least one previously set and registered terminal when the recording operation for the preset period of time is completed. To this end, the control device 170 may further include a recording module.

Further, the information about the emergency situations may further include image information. To this end, the control device 170 may further include a camera module (not shown). When the SOS button 175 is pressed, the controller controls an operation for capturing images of surroundings to be performed for a preset period of time from a point in time when the emergency signal is input (for example, for 10 seconds or 1 minute from the point in time when the emergency signal is input), and controls the image information to be transmitted to at least one previously set and registered terminal when the image capturing operation for the preset period of time is completed. To this end, the control device 170 may further include a recording module.

As described above, various pieces of foregoing information about the emergency situations may be transmitted to at least one previously set and registered terminal, so that a guardian, a person concerned in the police, etc. can quickly recognize emergency situations of a user, thereby making a fast response such as a quick rescue operation, etc.

Meanwhile, the seat actuator 100 is required to have an easy and simple structure to be disposed adjacent to the toilet 150 and a structure for arrangement and miniaturization to occupy a minimum installation space. To this end, the seat actuator 100 may have various structures. The seat actuator 100 according to the disclosure employs a structure to be simply and easily installed at a side of the toilet 150 while occupying the minimum installation space. That is, the seat actuator 100 according to the disclosure is configured to operate the movable seat 110 through a simple structure without a gear assembly or the like complicated structure.

The base actuator 100 according to the disclosure basically includes a casing 10 adjacent to and stationarily mounted to the toilet 150, a driver 20 mounted to the inside of the casing 10, and a link assembly 60 producing lifting movement and pivoting movement of the movable base 110 as driven by the driver 20.

With this configuration, the base actuator 100 is protected from the outside by the casing 10 that makes a good outer appearance and protects internal elements. In other words, the driver 20 and the link assembly 60 are provided inside the casing 10. In particular, the driver 20 and the link assembly 60 are not connected to a separate linking medium (e.g. a stationary frame or the like) disposed inside the casing 10, but directly rotatably connected to the casing 10. With this, the structure is further simplified, and assembling and disassembling are more easily carried out.

Meanwhile, the seat actuators 100 according to the disclosure may form a pair to be respectively arranged at both lateral sides of the toilet 150. In other words, as shown in FIGS. 1 to 6, the seat actuators 100 according to the disclosure are respectively arranged at the opposite sides of the toilet 150 as one pair and operate synchronously with each other.

Like this, according to the disclosure, the seat actuators 100 for actuating the movable seat 110 are respectively arranged at both sides of the toilet 150 to form one pair, and therefore it is advantageously possible to make a smooth operation regardless of the weight of a user who uses the toilet 150 and prevent a failure due to excessive load.

As described above, the seat actuators 100 according to the disclosure may be respectively arranged at the opposite sides of the toilet 150. In this case, the seat actuators 100 have the same configurations and operations. Therefore, the configuration and operations of one seat actuator 100, i.e. one seat actuator 100 arranged at a first side of the toilet 150 between one pair of seat actuators 100 will be described representatively, and the same description will be applied to the configuration and operations of the other seat actuator 100. Of course, the seat actuator 100 may be arranged at only the first side of the toilet 150.

Below, the configuration and operations of the seat actuator 100, which is the core element of the disclosure, will be described in detail.

The casing 10 is adjacent to and stationarily mounted to the toilet 150. Specifically, the casing 10 may be coupled to and stationarily mounted to the toilet 150, or the casings 10 may be respectively installed at opposite sides of the toilet 150 and connected to each other and stationarily mounted by a connection frame (not shown).

The casing 10 allows the driver 20 and the link assembly 60 arranged therein to be firmly and stably pivoted. In other words, the casing 10 is formed with a pivoting connection pin (not shown) protruding inward so that one end of each of the driver 20 and the link assembly 60 can be pivotally connected thereto.

The driver 20 is stably mounted to the inside of the casing 10 and drives the link assembly 60 to operate so that an actuation bar 70 coupled to the movable base 110 can have the lifting movement and the pivoting movement by the link assembly 60.

The link assembly 60 operates as driven by the driver 20 and makes the actuation bar 70 coupled to the movable base 110 operate. The link assembly 60 is connected to the actuation bar 70, and the actuation bar 70 is detachably coupled to a coupling bar 120 formed in the bottom of the movable base 110, thereby resulting in giving the lifting movement and the pivoting movement to the movable base 110 as the actuation bar 70 operates.

In brief, the link assembly 60 is connected to the actuation bar 70 detachably coupled to the coupling bar 120 formed in the bottom of the movable base 110 and is driven by the driver 20 to operate the actuation bar 70, thereby producing the lifting movement and the pivoting movement of the movable base 110.

The actuation bar 70 is firmly connected to but detachable from the coupling bar 120, and the coupling bar 120 is firmly coupled to the bottom of the movable base 110, so that the movable base 110 can have the lifting movement and the pivoting movement according to the operation of the link assembly 60. The link assembly 60 producing the movement of the actuation bar 70 may be variously configured as long as it can be driven by the driver 20 to transfer the lifting movement and the pivoting movement of the movable base 110 to the actuation bar 70.

According to an embodiment of the disclosure, the movable base 110 is detachably coupled to the actuation bar 70. Specifically, the movable base 110 is detachably coupled to the actuation bar 70 via the coupling bar 120 formed in the bottom thereof. In result, the movable base 110 is easily attached to and detached from the actuation bar 70, thereby reducing time, efforts and costs for assembling and disassembling, and maintenance of the apparatus for lifting a movable base of a toilet.

According to an embodiment of the disclosure, the link assembly 60 includes a first pivoting link 40 having a first end pivotally connected to the casing 10 and a second end pivotally connected to the actuation bar 70, and a second pivoting link 50 placed above the first pivoting link 40 and having a first end pivotally connected to the casing 10 and a second end pivotally connected to the actuation bar 70.

The first pivoting link 40 has the first end pivotally coupled to the inside of the casing 10 and the second end pivotally coupled to the actuation bar 70. Likewise, the second pivoting link 50 has the first end pivotally coupled to the inside of the casing 10 and the second end pivotally coupled to the actuation bar 70. Here, the second pivoting link 50 is placed above the first pivoting link 40.

Like this, the first ends of the first pivoting link 40 and the second pivoting link 50 are pivotally coupled to the inside of the casing 10, and the second end thereof are pivotally coupled to the actuation bar 70, so that the actuation bar 70 can operate when the driver 20 applies a driving force to the first pivoting link 40 or the second pivoting link 50, and therefore the movable base 110 coupled to the actuation bar 70 via the coupling bar 120 can operate to have the lifting movement and the pivoting movement.

The driver 20 includes a driving shaft 21 pivotally connected to the first pivoting link 40 or the second pivoting link 50. To make the driver 20 have the minimum driving load and enhance driving stability, the driving shaft 21 may be connected to a portion adjacent to a point at which pivotal connection with the actuation bar 70 is made, i.e. a portion adjacent to the second end of the first pivoting link 40 or second pivoting link 50.

Because the first pivoting link 40 and the second pivoting link 50 have not only the lifting movement but also the pivoting movement, the driver 20 is also pivotally connected to the first pivoting link 40 or the second pivoting link 50. Specifically, the driver 20 is pivotally connected to the casing 10, and the driving shaft 21 of the driver 20 is driven to move forward and backward by the driver 20 as pivotally connected to the first pivoting link 40 or the second pivoting link 50.

Because the driving shaft 21 of the driver 20 is pivotally coupled to the first pivoting link 40 or the second pivoting link 50, the actuation bar 70 connecting with the second ends of the first pivoting link 40 and the second pivoting link 50 may operate to have the lifting movement and the pivoting movement as the driving shaft 21 is driven to move forward and backward.

Meanwhile, the first pivoting link 40 and the second pivoting link 50 have the pivoting movement as driven by the driver 20, and thus the driver 20 pivotally connected to the first pivoting link 40 or the second pivoting link 50 is also directly pivotally coupled to the inside of the casing 10.

The driver 20 may employ various drivers such as a hydraulic cylinder, a pneumatic cylinder, etc. Further, the driver 20 may be pivotally coupled to the first pivoting link 40 by taking structural stability and operation without interference into account.

Meanwhile, the movable base 110 operates to have both the lifting movement and the pivoting movement, and therefore the actuation bar 70 detachably coupled to the coupling bar 120 formed in the bottom of the movable base 110 is also required to connect with the first pivoting link 40 and the second pivoting link 50 to thereby generate both the lifting movement and the pivoting movement.

To this end, the first pivoting link 40 and the second pivoting link 50 according to an embodiment of the disclosure are arranged in parallel with each other, and the second pivoting link 50 is longer than the first pivoting link 40. In detail, the first pivoting link 40 and the second pivoting link 50 are pivotally coupled to the casing 10 and the actuation bar 70 while being in parallel with each other, and the length (i.e. a distance from a point for pivotally coupling with the casing 10 to a point for pivotally coupling with the actuation bar 70) of the second pivoting link 50 placed above is greater than the length (i.e. a distance from a point for pivotally coupling with the casing 10 to a point for pivotally coupling with the actuation bar 70) of the first pivoting link 40 placed below. In this case, the stationary link 30 is coupled and disposed vertically to the base frame 11.

Due to difference in arrangement and length between the first pivoting link 40 and the second pivoting link 50, the movable seat 110 may operate to have both the lifting movement and the pivoting movement while moving from a down state (see FIG. 2) to an up state (FIG. 3).

Meanwhile, there is a need of stably supporting the actuation bar 70 in the state that the movable base 110 is moved down (in the state of FIG. 2) and preventing the movable base 110 from excessively moving down due to a user's weight. To this end, a supporting stopper 11 may be provided in a lower inside of the casing 10 in order to support the lower end of the actuation bar 70 and perform a stopping operation. With this, the actuation bar 70 and the link assembly 60 are not overloaded, thereby being prevented from damage and extending their lives.

Further, a supporting pad 117 may be provided on the bottom of the movable base 110 separately from or in addition to the supporting stopper 11. The supporting pad 117 may be formed as an elastic member. Therefore, it is possible to absorb a shock when the movable base 110 is put down on an entrance rim of the toilet 150, and thus the actuation bar 70 and the link assembly 60 are not overloaded, thereby being prevented from damage and extending their lives.

Meanwhile, the apparatus 200 for lifting a movable base of a toilet according to an embodiment of the disclosure may include a safety bar 90 to take a user's safety into account while assisting a user's behavior. The safety bar 90 according to an embodiment of the disclosure is coupled and formed above the movable base 110 and extended upward and frontward, and has a structure where an upper front portion thereof can be opened and closed.

The safety bar 90 forms a pair. Specifically, the safety bar 90 includes a first safety bar 90 coupled to one side of the movable base 110, and a second safety bar 90 coupled to the other side of the movable base 110, so that the front ends of the first safety bar 90 and the second safety bar 90 can be detachably coupled to each other.

FIG. 4 illustrates a closed front portion of the movable base 110 when both the safety bars 90 are coupled to each other, and FIGS. 5 and 6 illustrate an opened upper front portion of the movable base 110 when both the safety bars 90 are separated from each other. In more detail, FIG. 4 shows that the front end portions of both the safety bars 90 are locked to each other with the closed upper front portion of the safety bar 90, and FIGS. 5 and 6 show that the front end portions of both the safety bars 90 are released from each other with the opened upper front portion of the safety bar 90.

Both the safety bars 90 generally have the same structure. Therefore, the configurations and features of the safety bar 90 to be described below are equally applied to both the safety bars 90. However, the opposite safety bars 90 are different only in their ends, i.e. have different second ends of fourth joint bars 99 because both the safety bars 90 because they are structured to be detachably coupled at their ends. Specifically, the second end of the fourth joint bar 99 of the first safety bar 90 and the second end of the fourth joint bar 99 of the second safety bar 90 are structured to be detachably coupled to each other.

The safety bar 90 is divided into a stationary connecting portion and a joint connecting portion. Specifically, the stationary connecting portion includes a horizontal supporter 91 disposed above a lateral portion of the movable base 110, and a pair of vertical supporters 92 connecting the lower end of the horizontal supporter 91 and the lateral portion of the movable base 110.

The horizontal supporter 91 may be structured to be used as an armrest by a user while the user is using the toilet, and the pair of vertical supporters 93 stably and firmly supports the horizontal supporter 91 in such a manner that one of them connects a first lower end of the horizontal supporter 91 and a back lateral portion of the movable base 110 and the other one connects a second lower end of the horizontal supporter 91 and a front lateral portion of the movable base 110.

Such connected stationary connecting portions of the opposite safety bars 90 maintain a firm and stable posture when they are respectively coupled to both the lateral portions of the movable base 110, and thus are not deformed while being in use. Therefore, a user can keep a comfortable posture by resting his/her arm on the horizontal supporter 91 while using the toilet.

The joint connecting portions of the opposite safety bars 90 are connected to the stationary connecting portions, specifically, to the second ends of the horizontal supporter 91 (i.e. the portions facing the left side in FIGS. 2 and 3), and extended in a front upper direction of the movable base 110. The joint connecting portions of the opposite safety bars 90 are extended in the front upper direction of the movable base 110 and detachably coupled to each other at their ends.

The joint connecting portions of the opposite safety bars 90 include a first joint bar 93, a second joint bar 95, a third joint bar 97, and a fourth joint bar 99. The first joint bar 93 includes a first end stationarily connected to a second end of the horizontal supporter 91, and a second end connected to the second joint bar 95 via a first pivoting connecter 94.

The second joint bar 95 has a first end joined to the second end of the first joint bar 93 by the first pivoting connecter 94 so as to be pivotable 360° around a virtual first pivot axis (not shown). The virtual first pivot axis refers to a virtual pivot axis extended in a lengthwise direction along the center of the first joint bar 93. Therefore, the second joint bar 95 can pivot 360° around the virtual first pivot axis with respect to the first joint bar 93.

The third joint bar 97 has a first end joined to a second end of the second joint bar 95 by a second pivoting connecter 96 so as to be pivotable with a joint structure around a virtual second pivot axis (not shown). The virtual second pivot axis refers to a virtual pivot axis extended in a diameter direction of a portion of the second joint bar 95 joined to the third joint bar 97. Therefore, the third joint bar 97 is pivotable around the virtual second pivot axis with respect to the second joint bar 95.

The fourth joint bar 99 has a first end joined to a second end of the third joint bar 97 by a third pivoting connecter 98 so as to be pivotable with a joint structure around a virtual third pivot axis (not shown). The virtual third pivot axis refers to a virtual pivot axis extended in a diameter direction of a portion of the third joint bar 97 joined to the fourth joint bar 99. Therefore, the fourth joint bar 99 is pivotable around the virtual third pivot axis with respect to the third joint bar 97.

The virtual second pivot axis and the virtual third pivot axis are different in position because they correspond to pivot axes formed in the second pivoting connecter 96 and the third pivoting connecter 98. However, the virtual second pivot axis and the virtual third pivot axis may be formed in parallel with each other, and may also be formed to make the third joint bars 97 and the fourth joint bars 99 of the opposite safety bars 90 be pivoted in a direction of opening the front portion of the safety bar 90 as shown in FIG. 5, when a user applies an external force so that the front portion of the opposite safety bar 90 can be separated and moved away from each other in the state before the apparatus for lifting a movable base of a toilet operates (i.e. in the movable-base down state, see FIG. 2). In other words, the virtual second pivot axis and the virtual third pivot axis are formed in parallel with each other, so that the third joint bar 97 and the fourth joint bar 99 can be pivoted in the direction of opening the front portion of the safety bar 90.

The fourth joint bars 99 of the opposite safety bars 90 are structured to be detachably coupled to each other as described above. Therefore, the second end of the fourth joint bar 99 of the first safety bar 90 and the second end of the fourth joint bar 99 of the second safety bar 90 are different in structure from each other and have a structure for being attached to and detached from each other. Such a detachable coupling structure may employ various structures, for example, a structure where the second end of the fourth joint bar 99 of the first safety bar 90 is locked as inserted in the second end of the fourth joint bar 99 of the second safety bar 90 and separated or released when pulled away from each other while pressing a press button.

shown in FIG. 5, when a user applies an external force so that the front portion of the opposite safety bar 90 can be separated and moved away from each other in the state before the apparatus for lifting a movable base of a toilet operates (i.e. in the movable-base down state, see FIG. 2).

FIG. 6 shows that the front portion of the safety bar 90 is opened as the opposite safety bars 90 are separated in the state after the apparatus for lifting a movable base of a toilet according to an embodiment of the disclosure operates (i.e. in the movable-base up state). When the connected portion (i.e. the second ends of the opposite fourth joint bars 99) between the opposite safety bars 90 are released or separated in the state that the movable base 110 is moved up, the second joint bar 95 joined to the third joint bar 97 and the fourth joint bar 99 is pivoted around the virtual first pivot axis with respect to the first joint bar 93 by the weight of the joint connecting portion (i.e. the third joint bar 97 and the fourth joint bar 99), and the third joint bar 97 and the fourth joint bar 99 are respectively pivoted through the second pivoting connecter 96 and the third pivoting connecter 98 and bent down to thereby cause a sag. In result, the front portion of the safety bar 90 is opened so that a user can step out.

Meanwhile, the pair of safety bars 90 are respectively coupled to the opposite lateral portions of the movable base 110, as described above. Specifically, the first safety bar 90 is connected to one lateral portion of the movable base 110, and the second safety bar 90 is connected to the other lateral portion of the movable base 110. Therefore, a user who is using the toilet can keep a comfortable posture by resting his/her arms on the opposite safety bars 90, in particular, the opposite horizontal supporters 91 while sitting on the movable base 110.

However, users who will use the toilet 150 may be different in physique from each other. Therefore, a distance between the opposite safety bars 90 may be required to be adjustable according to a user's physiques. To this end, the opposite lateral portions of the movable base 110 are formed with fastening portions 115 into which the lower ends of the vertical supporters 92 forming a pair in the opposite safety bar 90 are inserted and fastened. In other words, the fastening portions 115, into which the lower ends of the vertical supporters 92 forming a pair in the opposite safety bar 90 are inserted and fastened, are respectively formed in a front side and a back side of one lateral portion of the movable base 110, and the fastening portions 115, into which the lower ends of the vertical supporters 92 forming a pair in the opposite safety bar 90 are inserted and fastened, are respectively formed in a front side and a back side of the other lateral portion of the movable base 110.

The lower side of each vertical supporter 92 is curved and extended in a horizontal direction, and such a portion extended in the horizontal direction is inserted in and fastened to the fastening portion 115. The fastening portion 115 is shaped like a groove to accommodate the horizontally extended portion of the vertical supporter 92 in the horizontal directions (see the arrow in FIG. 5).

Each fastening portion 115 is formed with at least two space adjusting holes 116 thereon. Although FIGS. 1 to 6 show only one space adjusting hole 116, at least two space adjusting holes 116 are formed in practice. In the state that the horizontally extended portion of the lower side of the vertical supporter 92 is inserted in the corresponding fastening portion 115, a position locking pin (not shown) is inserted in the space adjusting hole 116 and a locking hole (not shown) formed in the horizontally extended portion of the lower side of the vertical supporter 92 corresponding to the space adjusting hole 116, and then fastened to each fastening portion.

With this structure, the spacing distance between the opposite safety bars 90 is adjustable according to physiques of a user. In other words, the spacing distance between the opposite safety bars 90 is adjustable by adjusting a length, by which the horizontally extended portion of the lower side of each vertical supporter 92 is inserted in the corresponding fastening portion 115, and then fastening the horizontally extended portion of the lower side of each vertical supporter 92 to the corresponding fastening portion 115. Therefore, there are no structural problems because the joint connecting portions of the safety bar 90 are connected by the joints as described above even though the spacing distance between both the safety bars is adjusted. Accordingly, it is possible to adjust the spacing distance of the opposite safety bars without structural problems.

By an apparatus for lifting a movable base of a toilet according to the disclosure with the foregoing objects, solutions, and effects, it is possible to simplify a structure by making the movable base where the toilet user sits be automatically movable with a simple structure, be driven to have lifting movement and pivoting movement, and be structured to minutely generate the pivoting movement, and which can quickly deal with emergency situations of a user by making an alarm go off in the emergency situations and transmitting information about the emergency situations to at least one previously set terminal.

Although a few exemplary embodiments of the disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An apparatus for lifting a movable base of a toilet, comprising:

the movable base structured to allow a user of the toilet to sit thereon, and movably mounted to the toilet;

a base actuator disposed adjacent to the toilet and actuating the movable base to operate having at least one of lifting movement and pivoting movement, and a control device controlling operations of the base actuator, wherein the control device comprises an SOS button, a speaker making an alarm go off, and a controller controlling the alarm to go off through the speaker when the SOS button is pressed and controlling information about emergency situations to be transmitted to at least one previously set terminal, wherein the base actuator comprises:

a casing adjacent to and stationarily mounted to the toilet;

a driver mounted to an inside of the casing; and a link assembly connected to an actuation bar detachably coupled to a coupling bar formed in a bottom of the movable base, and operating the actuation bar to produce lifting movement and pivoting movement of the movable base as driven by the driver, wherein the link assembly comprises a first pivoting link having a first end pivotally connected to the casing and a second end pivotally connected to the actuation bar, and a second pivoting link placed above the first pivoting link and comprising a first end pivotally connected to the casing and a second end pivotally connected to the actuation bar, and the driver is pivotally connected to the casing, and a driving shaft of the driver is driven to move forward and backward by the driver as pivotally connected to the first pivoting link or the second pivoting link.

2. The apparatus for lifting a movable base of a toilet according to claim 1, wherein the first pivoting link and the second pivoting link are disposed in parallel with each other, and the second pivoting link is longer than the first pivoting link.

* * * * *